US009732298B2

(12) United States Patent
Laroche et al.

(10) Patent No.: US 9,732,298 B2
(45) Date of Patent: Aug. 15, 2017

(54) PROCESS FOR THE TREATMENT OF LIQUEFIED HYDROCARBON GAS USING 3-(AMINO) PROPANE-1,2-DIOL COMPOUNDS

(71) Applicant: Dow Global Technologies LLC, Midland, MI (US)

(72) Inventors: Christophe R. Laroche, Lake Jackson, TX (US); James M. Hill, Lake Jackson, TX (US)

(73) Assignee: Dow Global Technologies LLC, Midland, MI (US)

( * ) Notice: Subject to any disclaimer, the term of this patent is extended or adjusted under 35 U.S.C. 154(b) by 113 days.

(21) Appl. No.: 14/399,783

(22) PCT Filed: Jun. 11, 2013

(86) PCT No.: PCT/US2013/045113

§ 371 (c)(1),
(2) Date: Nov. 7, 2014

(87) PCT Pub. No.: WO2013/188361

PCT Pub. Date: Dec. 19, 2013

(65) Prior Publication Data

US 2015/0141731 A1 May 21, 2015

Related U.S. Application Data

(60) Provisional application No. 61/660,161, filed on Jun. 15, 2012.

(51) Int. Cl.

| | |
|---|---|
| ***C10L 3/12*** | (2006.01) |
| ***C10G 21/12*** | (2006.01) |
| ***C10G 29/20*** | (2006.01) |
| ***C10G 21/20*** | (2006.01) |
| ***C10L 3/10*** | (2006.01) |

(52) U.S. Cl.

CPC ..... *C10L 3/12* (2013.01); *C10G 21/20* (2013.01); *C10G 29/20* (2013.01); *C10L 3/102* (2013.01); *C10L 3/103* (2013.01); *C10L 2290/541* (2013.01)

(58) Field of Classification Search

None

See application file for complete search history.

(56) References Cited

U.S. PATENT DOCUMENTS

| | | | | |
|---|---|---|---|---|
| 4,808,765 | A | 2/1989 | Pearce et al. | |
| 5,736,115 | A | 4/1998 | Iijima et al. | |
| 5,877,386 | A | 3/1999 | Schubert | |
| 6,436,174 | B1 | 8/2002 | Grossmann et al. | |
| 2003/0141223 | A1 | 7/2003 | Waner et al. | |
| 2015/0112113 | A1* | 4/2015 | Laroche | C10G 21/20 585/860 |
| 2015/0126793 | A1* | 5/2015 | Laroche | C10G 21/20 585/860 |

FOREIGN PATENT DOCUMENTS

| | | |
|---|---|---|
| EP | 013948 | 3/1985 |
| EP | 0776687 | 6/1997 |
| EP | 2283911 | 2/2011 |
| JP | SH60-048116 | 3/1985 |
| JP | HEI-09-150029 | 6/1997 |
| JP | 2002-519171 | 7/2002 |
| JP | 2003-535209 | 11/2003 |
| WO | 2013/045113 | 4/2005 |

OTHER PUBLICATIONS

Nielsen et al., "Treat LPGs with Amines", Bryan Research and Engineering, Inc.—Technical Papers, Jan. 1, 2006, pp. 1-12 (12 pages).

* cited by examiner

*Primary Examiner* — Tam M Nguyen
(74) *Attorney, Agent, or Firm* — Akerman LLP

(57) ABSTRACT

A method for treating liquefied hydrocarbons including acid gases to remove said acid gases while minimizing loss of amine species, said method comprising the steps of contacting the liquefied hydrocarbons with an absorbent aqueous solution of a first amine compound, the first amine compound having the structure:

wherein $R_1$ is propane-2,3-diol; $R_2$ is hydrogen, methyl ethyl, 2-hydroxyethyl, or propane-2,3-diol; and $R_3$ is hydrogen, methyl, ethyl, 2-hydroxyethyl or propane-2,3-diol.

9 Claims, 1 Drawing Sheet

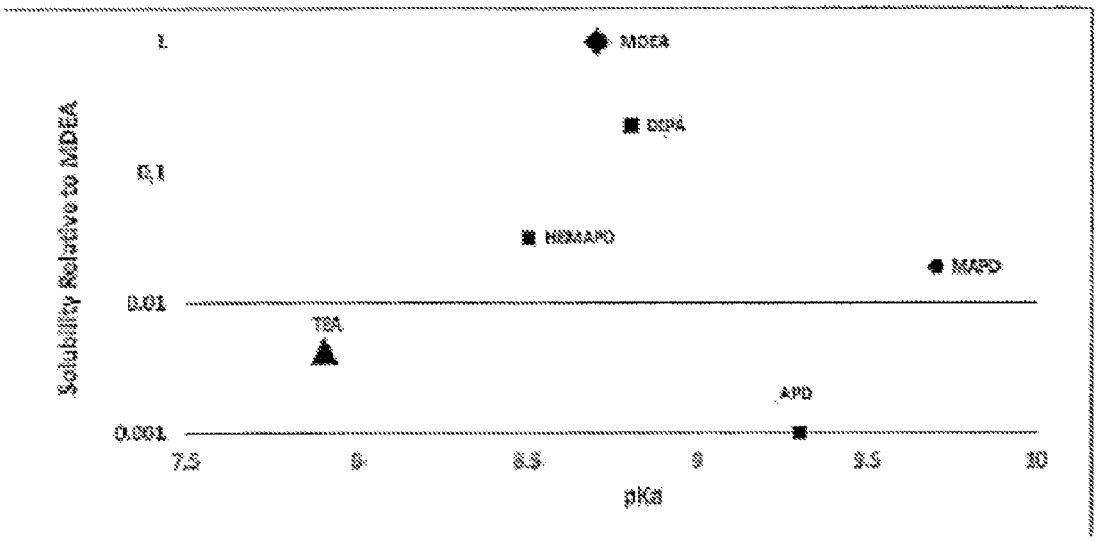
Solubility Relative to MDEA
1
0.1
0.01
0.001
MDEA
DEPA
HEMAPD
MAPD
TEA
APD
7.5
8
8.5
9
9.5
10
pKa

PROCESS FOR THE TREATMENT OF LIQUEFIED HYDROCARBON GAS USING 3-(AMINO) PROPANE-1,2-DIOL COMPOUNDS

FIELD OF THE INVENTION

The invention relates generally to processes for the treatment of liquefied hydrocarbon streams. More specifically, the invention relates to processes for removing acid gases from liquid hydrocarbons such as natural gas liquids (NGL) or liquid petroleum gas (LPG) streams using a 3-(amino) propane-1,2-diol compound.

BACKGROUND OF INVENTION

Liquefied hydrocarbon gas, such as liquid petroleum gas (LPG) or natural gas liquids (NGL) are a flammable mixture of hydrocarbon gases used as a fuel in heating appliances and vehicles. It is increasingly used as an aerosol propellant and a refrigerant, replacing chlorofluorocarbons in an effort to reduce damage to the ozone layer.

LPG is synthesized by refining petroleum or "wet" natural gas, and is almost entirely derived from fossil fuel sources, being manufactured during the refining of petroleum (crude oil), or extracted from petroleum or natural gas streams as they emerge from the ground Liquefied hydrocarbons may evaporate quickly at normal temperatures and pressures and are usually supplied in pressurized steel gas cylinders. These containers are typically filled to between 80% and 85% of their capacity to allow for thermal expansion of the contained liquid. The ratio between the volumes of the vaporized gas and the liquefied gas varies depending on composition, pressure, and temperature, but is typically around 250:1.

Liquefied hydrocarbon gas often contains a variety of acidic, gaseous contaminants, such as hydrogen sulfide, a variety of mercaptans and other diverse sulfur compounds, carbon dioxide, and carbonyl sulfide (COS). It is well known in the gas treating industry that such contaminants can be successfully removed by contacting gas or liquid hydrocarbon streams with aqueous solutions of one or more amines. Aqueous amine solutions may be either selective or non-selective in their ability to absorb particular acid gases.

After such absorption, the acidic compounds are stripped from the amines and the amines are returned to the system, except to the extent that the amine compounds may have been lost in the process. It has been theorized that many different amines would provide some level of utility for removal of acid gases. As a practical matter, however, the amines actually in commercial use are monoethanolamine (MEA), diethanolamine (DEA), methyldiethanolamine (MDEA), and diisopropanolamine (DIPA).

For example, use of MDEA/DIPA mixtures has also been reported (U.S. Pat. No. 4,808,765) for the purpose of removing $H_2S$ Treatment of liquefied hydrocarbon gas presents particular problems in that amines tend to be significantly soluble in these gases, leading to a corresponding economic penalty due to the need to make up the lost amine(s). Many refineries use aqueous DIPA or MDEA to remove the acidic impurities from liquefied hydrocarbon gas. However, the concentration of these amines is typically limited to the range of about 20-35 weight percent of the aqueous stream in which they are supplied to the process. Operation at higher concentrations, which is desirable for capacity reasons, generally results in undesirably high levels of liquid hydrocarbon gas contamination with amine(s).

The problem is particularly acute at refineries treating cracked (i.e., highly unsaturated) LPG. Often, the loss rate of MDEA is sufficient to negate the economic justification for substituting MDEA for DEA. In addition to the high amine replacement costs, specialized remediation equipment is required, which increases the financial burden. All of U.S. Pat. Nos. 5,326,385; 5,877,386; and 6,344,949 teach some type of "sweetening" of LPG through various processes which remove acidic gases. Further, U.S. Pat. No. 4,959,086 uses isomers of amine compounds to remove hydrogen sulfide from natural gas.

However, these publications present reasonable solutions to problems with amine absorption encountered when "sweetening" liquefied hydrocarbon gas but allow for improvement in the amine acid processes. It would be highly desirable to have an amine composition which maximizes the effective amine concentration circulating in the liquefied hydrocarbon gas system, while yet minimizes the amount of amine(s) lost due to solubility in the these gases.

SUMMARY OF THE INVENTION

In accordance with one aspect of the invention, there is provided a method for treating liquefied hydrocarbons comprising acid gases to remove said acid gases while minimizing loss of amine species. The method comprises the step of contacting the liquefied hydrocarbons with an absorbent aqueous solution of a first amine compound, the first amine compound having the structure:

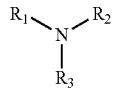

wherein $R_1$ is propane-2,3-diol; $R_2$ is hydrogen, methyl, ethyl, 2-hydroxyethyl, or propane-2,3-diol; and $R_3$ is hydrogen, methyl, ethyl, 2-hydroxyethyl or propane-2,3-diol.

When aqueous solutions of traditional alkanolamines such as methyldiethanolamine (MDEA) are used to treat liquefied petroleum gas within liquid/liquid processes, important amine losses can be encountered over time. The presence of hydroxyl groups has proved to be critical in reducing these losses by improving the lipophobic character of the molecule. Therefore, triethanolamine (TEA), incorporating three hydroxyl groups, remains the molecule of choice even though aqueous solution of MDEA proved to be superior to aqueous solutions of TEA in terms of performance and capacity for acid gas removal. The difference in performance and capacity between MDEA and TEA is mainly dictated by the difference in basic strength reflected by their respective pKa of 8.7 for MDEA and 7.9 for TEA.

Therefore, alkanolamine structures incorporating an increased number of hydroxyl groups and/or nitrogen-hydrogen bonds compared to MDEA while maintaining a low molecular weight along with a basic strength (i.e. pKa) equal or superior to TEA would be ideal candidates for treating liquefied petroleum gas within liquid/liquid processes.

The incorporation of propanediol moieties into alkanolamine structures allows for reduced solubility in hydrocarbon streams compared to equivalent alkanolamine structures incorporating hydroxyethyl moiety (i.e. traditional ethoxylated alkanolamines). The basic strength of amine incorporating further hydroxyl groups is not altered compared to traditional ethoxylated alkanolamines since inductive effects engendered by the presence of more than one hydroxyl group on the same substituent of nitrogen do not cumulate.

Moreover, most of these structures can be reached by the simple reaction between glycidol epoxide or 3-chloro-1, 2-propanediol with ammonia, methylamine or dimethylamine as seen below.

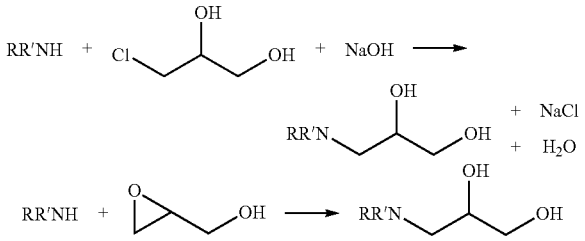

For purposes of this disclosure, liquefied hydrocarbons are those low molecular weight hydrocarbons which may be saturated or unsaturated, branched or unbranched ranging in size from about $C_1$ to $C_{20}$, preferably from about $C_1$ to $C_{12}$ and more preferably from about $C_2$ to $C_6$ such as for example, LPG or NGL, or mixtures thereof.

BRIEF DESCRIPTION OF THE FIGURES

FIG. 1 is a graphical illustration of the relative solubility of the tested amines compared to MDEA plotted against their pKa values.

DETAILED DESCRIPTION OF THE PREFERRED EMBODIMENTS

Generally, the invention is a method for treating liquefied hydrocarbons comprising the removal of acid gases while minimizing loss of amine species. The method comprises the step of contacting the liquefied hydrocarbons with an absorbent aqueous solution of a first amine compound, the first amine compound having the structure:

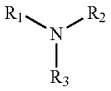

wherein $R_1$ is propane-2,3-diol; $R_2$ is hydrogen, methyl, ethyl, 2-hydroxyethyl, or propane-2,3-diol; and $R_3$ is hydrogen, methyl, ethyl, 2-hydroxyethyl or propane-2,3-diol.

A principal disadvantage of the amines commonly used in the prior art is their relativity high solubility in LPG. The invention addresses that problem by providing an amine compound with a lower LPG solubility.

Most refineries operate at a total amine concentration of no more than about 35 weight % of the amine-containing aqueous treatment composition. Operation at about 40 weight %, preferably even about 50 weight % total amine(s) or more is desirable since high strength solutions provide additional acid gas removal capacity at low cost. Also, it is likely that the concentration of sulfur in crude oil will rise in the future.

Accordingly, in order to maintain or increase production, the refinery must, on the average, process/remove more sulfur. Nevertheless, because of the increased loss of amines at the higher concentrations, it has not been economically feasible to operate above about the 35% level in most cases. One advantage of the invention is that it allows the refinery to operate economically at higher total amine strengths without the high amine replacement costs they would otherwise incur.

Generally, the compounds used in the process of the invention will have a structure:

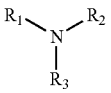

(1)

wherein $R_1$ is propane-2,3-diol; $R_2$ is hydrogen, methyl, ethyl, 2-hydroxyethyl, or propane-2,3-diol; and $R_3$ is hydrogen, methyl, ethyl, 2-hydroxyethyl or propane-2,3-diol. Useful amine aminopropanediol compounds include but are not limited to:

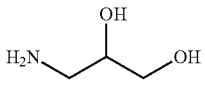

APD
3-aminopropane-1,2-diol

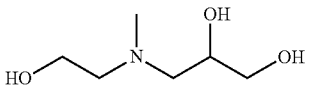

HEMAPD
3-(2-(hydroxyethyl) methylamino) propane-1,2-diol

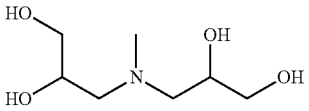

MABPD
3-(methylamino)bis(propane-1,2-diol)

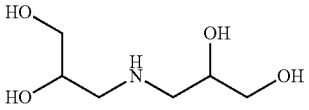

ABPD
3-(amibno)bis(propane-1,2-diol)

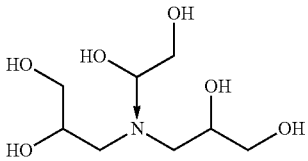

ATPD
3-(amino)tris(propane-1,2-diol)

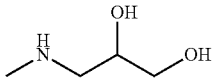

MAPD
3-(methylamino)propane-1,2-diol

Compounds such as these, as listed above, may be used individually or in mixture to comprise the first amine to sweeten or otherwise remove acidic gases from the untreated LPG. Generally, the first amine compound may be synthesized through any number of means known to those of skill in the art. Moreover, most of these structures can be synthesized by the simple reaction between glycidol epoxide or 3-chloro-1, 2-propanediol with ammonia, methylamine dimethylamine or 2-(methylamino)ethanol as seen below.

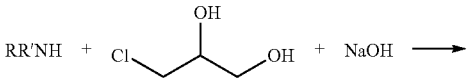

-continued

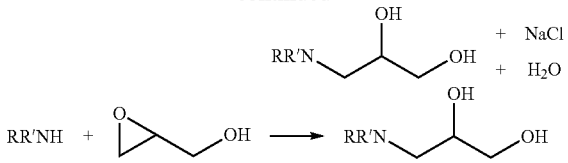

In addition to the first amine compound used in the process of the invention, the aqueous solution used to sweeten LPG may comprise a second amine compound. Amine compounds useful as the second amine compound include trisamine compounds such as 2-amino-2-(hydroxymethyl) propane-1,3diol, 2-methyl amino-2-(hydroxymethyl) propane-1,3-diol, dimethylamino-2-(hydroxymethyl)propane-1,3-diol, or mixtures thereof; piperazine compounds such as 3-(piperazin-1-yl)propane-1,2-diol, 3,3'-(piperazin-1,4-diyl)bis(propane-1,2-diol), or mixtures thereof; alkyl amines such as mono ethane amine, diethanolamine, methyldiethanolamine, diisopropananolamine, triethanolamine and mixtures thereof; and mixtures of compounds within each of these species heretofore listed above.

Method of Treatment

The process of this invention may be readily implemented by contacting LPG with the 3-aminopropane-1,2-diol compound mixtures in ordinary liquid-liquid contacting equipment, and under operating conditions within the ordinary limitations of such equipment. While some optimization of conditions, within the skill of the art, should preferably be done, it is to be expected that a reduction in amine solubility losses will be experienced even at existing operating conditions. A further advantage of the invention, therefore, is that it does not require significant substitutions or modifications in equipment, packing, operating conditions, and the like. Accordingly, the invention is particularly beneficial to refineries which need more acid gas removal capacity, but are reluctant to pay for extensive capital upgrades.

It is another advantage of this invention that operating parameters are not narrowly critical. As a general guideline, it may be said that the higher the concentration in the system, the higher will be the amine losses. Representative concentrations are found in the Table below. While there is not known specific upper limit on concentration, it is suggested that the concentration be held to no more than about 95 weight % of the amine mixture, the remaining being water, in order to avoid operational problems, such as inadequate removal of $H_2S$. A useful approach to determining the maximum usable concentration of in a given system is to gradually increase the content until problems are detected, then back off on the concentration until such problems disappear.

Similarly, there is no necessary minimum concentration, this concentration may be a matter of routine experimentation. It is suggested, however, as a starting point that the concentration be at least about 5 weight %. It is believed that, in the majority of cases, the useful range of concentrations will be about 10 to about 90 weight %, preferably about 25 to about 75 weight %, and more preferably about 35 to about 65 weight % of the amine mixture, the remaining being water.

Additionally, the aqueous absorbent composition may also comprise an acid such as boric acid, sulfuric acid, hydrochloric acid, phosphoric acid, and mixtures thereof. The concentration of acid may vary in an amount effective from 0.1 to 25 weight % and most preferably from 0.1 to 12 weight %. The acid source is effective in recovering the amine compound once the acid gas has been stripped from the system.

The operating temperature for the contacting of the LPG with the containing amine mixture is not narrowly critical, but will usually be in the range of about 50° F. to about 190° F., preferably about 70° F. to about 160° F., and more preferably about 80° F. to about 140° F.

In general terms, the lower temperatures are preferred in order to minimize solubility losses. Since most refineries do not have much flexibility in this regard, it is an advantage of this invention that significant reduction in amine loss will be effected at any given operating temperature.

WORKING EXAMPLES

The following examples provide a non-limiting illustration of the features of the invention.

A solution of heptane (10 g), toluene (0.1 g) and the tested amine (2.5 g) are mixed at 20° C. for 1 hours. The mixture is decanted for 15 minutes and the neat heptane phase is analyzed by gas chromatography using toluene as internal standard. The injection is repeated three times and peak areas of tested amine are averaged. Results are presented below:

| Amine | MDEA | TEA | DIPA | HEMAPD | APD | MAPD |
|---|---|---|---|---|---|---|
| area counts | 9210 | 40 | 2082 | 290 | 0 | 176 |

The pKa of the tested amines was recorded using an automated Mettler Toledo titration system using 50 weight % aqueous amine solutions and 0.5 N hydrochloric acid. Results are presented below:

| Amine | MDEA | TEA | HEMAPD | APD | MAPD |
|---|---|---|---|---|---|
| pKa | 8.7 | 7.9 | 8.5 | 9.3 | 9.7 |

Although the present invention has been described by reference to its preferred embodiment as is disclosed in the specification and drawings above, many more embodiments of the present invention are possible without departing from the invention. Thus, the scope of the invention should be limited only by the appended claims.

The claimed invention is:

1. A method for treating liquefied hydrocarbons comprising acid gases to remove said acid gases while minimizing loss of amine species, said method comprising the step of contacting said liquefied hydrocarbons with an absorbent aqueous solution of a first amine compound, said first amine compound having the structure:

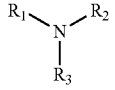

wherein $R_1$ is propane-2,3-diol; $R_2$ is hydrogen, methyl, ethyl, 2-hydroxyethyl, or propane-2,3-diol; and $R_3$ is hydrogen, methyl, ethyl, 2-hydroxyethyl or propane-2,3-diol.

2. The method of claim 1, wherein said absorbent aqueous solution comprises from about 0.1 wt. % to 90 wt. % of said first amine compound and additionally comprising from about 1 wt. % to 90 wt. % of a second amine compound.

3. The method of claim 1, wherein said absorbent aqueous solution comprises from about 0.1 wt. % to 50 wt. % of said first amine compound and additionally comprising from about 5 wt. % to 50 wt. % of a second amine compound.

4. The method of claim 1, wherein $R_1$ is propane-2,3-diol; $R_2$ is 2-hydroxyethyl and $R_3$ is methyl.

5. The method of claim 1, wherein $R_1$ and $R_2$ are propane-2,3-diol and $R_3$ is methyl.

6. The method of claim 1, wherein said acid gases comprise one or more gas selected from the group consisting of $CO_2$, $H_2S$, a mercaptan compound, COS, $CS_2$, and mixtures thereof.

7. The method of claim 1, wherein said aqueous solution comprises a second amine compound comprising a piperazine compound selected from the group consisting of piperazine, 2-methylpiperazine, 1-hydroxyethylpiperazine, 3-(piperazin-1-yl)propane-1,2-diol, 3,3'-(piperazin-1,4-diyl) bis(propane-1,2-diol) and mixtures thereof.

8. The method of claim 1, wherein said absorbent aqueous solution comprises a second amine compound selected from the group consisting of triethanolamine, diethanolamine, methyldiethanloamine, diisopropanolamine, 2-amino-2-(hydroxymethyl)propane-1,3-diol, 2-methylamino-2(hydroxymethyl) propane-1,3-diol, 2-dimethylalmino-2-(hydroxymethyl)propane-1,3-diol and mixtures thereof.

9. The method of claim 1, wherein said absorbent aqueous solution additionally comprises an acid, said acid selected from the group consisting of boric acid, hydrochloric acid, sulfuric acid, phosphoric acid and mixtures thereof.

* * * * *